United States Patent [19]

Becker, Jr. et al.

[11] Patent Number: 4,502,433

[45] Date of Patent: Mar. 5, 1985

[54] VALVE CONSTRUCTION FOR MULTI-FUEL ENGINE

[75] Inventors: Theodore Becker, Jr., Chillicothe; Sam R. Congram, Peoria; Carl L. McClung, Metamora, all of Ill.

[73] Assignee: Caterpillar Tractor Co., Peoria, Ill.

[21] Appl. No.: 325,176

[22] Filed: Nov. 27, 1981

Related U.S. Application Data

[63] Continuation of Ser. No. 055,583, Jul. 9, 1979, abandoned, which is a continuation-in-part of Ser. No. 916,972, Jun. 19, 1978, abandoned, which is a continuation-in-part of Ser. No. 822,844, Aug. 8, 1977, abandoned.

[51] Int. Cl.[3] ..... F01L 3/22

[52] U.S. Cl. ..... 123/188 S; 123/90.28

[58] Field of Search ..... 123/90.28, 90.30, 90.65, 123/90.67, 188 S

[56] References Cited

U.S. PATENT DOCUMENTS

| | | | |
|---|---|---|---|
| 2,270,990 | 1/1942 | Bachle | 123/188 S |
| 2,800,122 | 7/1957 | Howell | 123/188 S |
| 2,847,981 | 8/1958 | Sampietro | 123/90.3 |
| 2,863,428 | 12/1958 | Norton | 123/90.3 |
| 3,081,754 | 3/1963 | Georges | 123/188 S |

OTHER PUBLICATIONS

Williams, C. G., "Valve Seat Wear", *The Automobile Engineer*, Jan. 1935, pp. 23-24.

*Primary Examiner*—Craig R. Feinberg
*Assistant Examiner*—W. R. Wolfe
*Attorney, Agent, or Firm*—William B. Heming

[57] ABSTRACT

A multi-fuel engine is capable of running on lead free gasoline, leaded gasoline, and liquid propane. The engine has a valve seat and an exhaust valve. The valve seat has a seating surface. The exhaust valve has an axis, a seating face, and is of dimensions sufficient for seating of the valve on the valve seat. The seating surface has a width in a range of about 2.30 to about 2.90 millimeters and defines an included angle in a range of about 110° to about 130° relative to the axis of the exhaust valve. Apparatus forcibly urges the seating face against the seating surface at a force in a range of about 200 to about 245 Newtons.

3 Claims, 3 Drawing Figures

Fig. 1
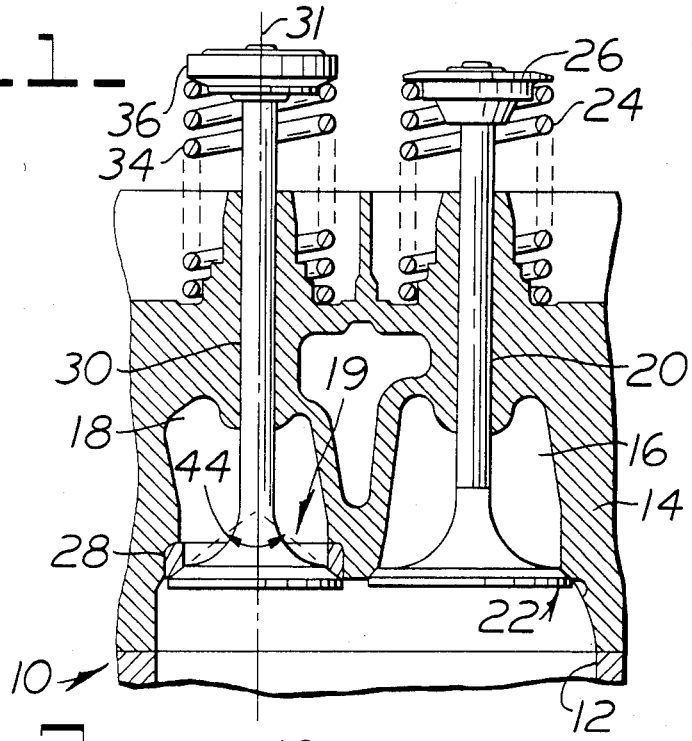
Fig. 2
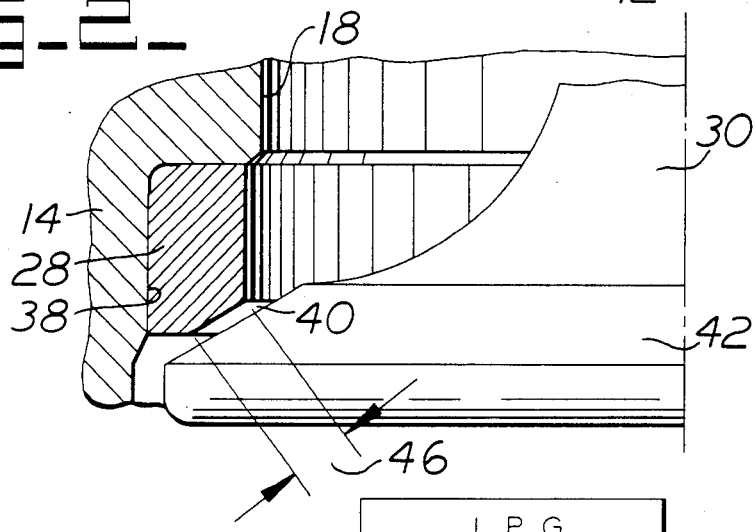
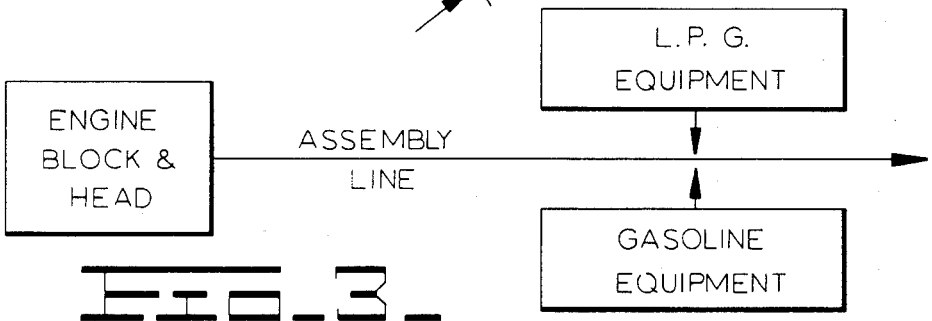
Fig. 3

VALVE CONSTRUCTION FOR MULTI-FUEL ENGINE

DESCRIPTION

CROSS REFERENCE TO RELATED APPLICATIONS

This is a continuation of Ser. No. 055,583, filed July 9, 1979, now abandoned, which is a continuation-in-part of Application Ser. No. 916,972 filed June 19, 1978, by T. H. Becker, Jr. et al, now abandoned, which is a continuation-in-part of Application Ser. No. 822,844 filed Aug. 8, 1977, by T. H. Becker, Jr. et al now abandoned.

BACKGROUND OF THE INVENTION

This invention relates to internal combustion engines, and more particularly to exhaust valve constructions for use in such engines.

Internal combustion engines can be operated on a wide variety of fuels and while most are run on either diesel fuel or gasoline, many are designed to run on bottled gas, such as liquid propane. Lift trucks, for example, are frequently fueled with bottled gas.

Heretofore, special provisions have had to be made to adapt moving parts of internal combustion, reciprocating engines for use with liquid gas fuels, as liquid propane. Consequently, assembly problems have been accentuated due to the need for two sets of parts, one for gasoline and one for bottled gas.

The problem is being accentuated through the increased emphasis on low lead or lead-free gasolines which pose the need for still further modifications to component configurations to optimize efficiency.

SUMMARY OF THE INVENTION

The present invention is directed to overcoming one or more of the above problems.

According to the present invention, there is provided an engine which is ideally suited for running on low lead or lead-free gasoline, leaded gasoline, and liquid gas fuels. The invention contemplates a valve seat having a seating surface and an exhaust valve having an axis and a seating face. The exhaust valve is of dimensions sufficient for seating of the valve on the valve seat. The seating surface of the valve seat has a width in a range of about 2.30 to about 2.90 millimeters and defines an included angle in a range of about 110° to about 130° relative to the axis of the exhaust valve. Means forcibly urges the seating face against the seating surface at a force in a range of about 200 to about 245 Newtons.

As a consequence of the foregoing construction, identical engine block and head assemblies for use with any type of the above-mentioned fuels can be manufactured in a single assembly line using the same components other than carburetion components to eliminate the need for specially designed components housed by the block and head assembly suited for use with only one of the types of fuel mentioned.

DESCRIPTION OF THE DRAWINGS

FIG. 1 is a partial, sectional view, fragmentary in nature, of an engine embodying an exhaust valve made according to the invention.

FIG. 2 is an enlarged, fragmentary view illustrating the valve and valve seat.

FIG. 3 is a schematic illustrating an assembly method that may be utilized with block and head assemblies with exhaust valves made according to the invention.

DESCRIPTION OF THE PREFERRED EMBODIMENT

An exemplary embodiment of an engine made according to the invention is illustrated in FIG. 1 as an overhead valve engine although it will be appreciated that the invention may be utilized in flat head engines as well. The engine includes a block 10 having at least one cylinder 12 formed therein. Secured to the block 10, in any conventional fashion, is a head 14 which contains an intake port 16 and an exhaust port 18 for each of the cylinders 12 in the block 10 and an exhaust valve seat 19.

An intake valve 20 is mounted for reciprocation within the head 14 for positions opening and closing the intake port 16, the valve 20 seating on a seat 22 formed in the head 14 about the port 16. The valve 20 is provided with a spring 24 for normally closing the valve and a conventional valve rotator 26. The valve 20 is actuated by a rocker arm of conventional construction (not shown).

The exhaust port 18 opens to the cylinder 12. An exhaust valve 30 is mounted on the head 14 for axial movement between positions opening and closing the port 18. The exhaust valve 30 has an axis 31. Means 34, shown as a valve spring 34, is provided for biasing the valve 30 toward a closed position. Means 36, shown as a conventional rotator 36, is preferably associated with the valve 30 for rotating the same through a small angular displacement in response to axially moving the valve 30.

It is desirable that the valve seat 19 be an insert 28. The valve seat 19 has a seating surface 40. The exhaust valve 30 is of dimensions sufficient for seating of the valve 30 on the valve seat 19. Referring now to FIG. 2, the head 14 is provided with an annular recess 38 about the port 18 which receives the insert 28. The insert 28 may be formed of any conventional material used for the purposes and includes the seating surface 40 on one side thereof. The valve 30 includes a seating surface 42 which seats against the surface 40 when the valve 30 is closed. Both the seating surface 40 and face 42 are frusto-conical and, as seen in FIG. 1, the surface 40 defines an included angle 44 relative to the axis 31 of the valve 30. The included angle 44 of the frusto-conical surface 40 is in a range of about 110° to about 130° with a preferred value of about 118° 30′.

The seating face 42 is arranged at an angle complementary to that of the seating surface 40. (In the usual case, the surfaces 40 and 42 will, when new, diverge about 1° as is well known in the art, and the present invention contemplates the use of this conventional practice.) The seating surface 40 has a width 46 in a range of about 2.30 to about 2.90 millimeters. The width is preferably about 2.62 millimeters.

The foregoing angular and width interrelationships are essential to the present invention. A further essential relationship is the seating force applied to the valve 30 by the spring 34. The spring 34 forcibly urges the seating face 42 of the valve 30 against the seating surface 40 of the valve seat 19 at a force in a range of about 200 to about 245 Newtons. The force is preferably about 222 Newtons.

It has been determined that when an exhaust valve is made according to the above parameters, the valve will allow the engine to operate with optimum efficiency on lead-free gasoline, low lead gasoline, conventional leaded gasoline, and bottled liquid gases such as liquid propane. The use of the parameters in a multi-fuel engine provides a crushing action on deposits forming on the seating surface 40 of the valve seat 19 for removing the deposits during operation of the engine to prevent build-up of said deposits. As a consequence, moving components within the block and head assembly need not be varied, depending upon the intended fuel with which the engine is to be used.

Thus, identical engine block and head assemblies embodying valves made according to the invention may be manufactured on a single assembly line regardless of the fuel with which they are intended to be used. Such block and head assemblies may be moved to a station whereat carburetion components unique to the particular type of fuel with which the engine is intended to be used may be applied, such as LPG carburetion equipment or gasoline carburetion equipment, as illustrated in FIG. 3. While the finished engine can only be operated on the type of fuel for which its carburetion equipment was intended, considerable expense in fabrication and inventory costs is avoided since the only components of the finished engine specific to a given type of fuel are carburetion structures.

Other aspects, objects, and advantages of this invention can be obtained from a study of the drawings, the disclosure, and the appended claims.

The embodiments of the invention in which an exclusive property or privilege is claimed are defined as follows:

1. In an engine for efficiently burning leaded gasoline, unleaded gasoline and liquid propane fuels, said engine having a head, a valve seat having a seating surface and a mean seat diameter, and an exhaust valve having an axis, a seating face and being of dimensions sufficient for seating of the valve on the valve seat, the improvement comprising:

an insert having a surface and being positioned in the head;

said seating surface of the valve seat having a width in a range of about 2.30 to about 2.90 millimeters and defining an included angle in a range of about 110° to about 130° relative to the axis of the exhaust valve and being formed by the surface of said insert;

said mean seat diameter of said valve seat being dimensionally greater than said width of said seating surface by a factor of about 14;

a valve spring urging said exhaust valve against said valve seat at a force of about 200 Newtons and not less than 200 Newtons; and a valve rotator for rotating said exhaust valve in response to axial movement of said exhaust valve.

2. In an engine for efficiently burning leaded gasoline, unleaded gasoline and liquid propane fuels, said engine having a valve seat having a seating surface and a mean seat diameter; and an exhaust valve having an axis, a seating face, and being of dimensions sufficient for seating of the valve on the valve seat, the improvement comprising:

said seating surface of the valve seat having a width of about 2.62 millimeters and defining an included angle in a range of about 118° 30′ relative to the axis of the exhaust valve;

said mean seat diameter being dimensionally about 14 times the width of said seating surface of the valve seat;

means for rotating the exhaust valve in response to axial movement of the exhaust valve; and means for urging said seating face of the exhaust valve against the seating surface of the valve seat at a force of about 200 Newtons and not less than 200 Newtons.

3. The engine, as set forth in claim 2 including an insert at said valve seat and wherein the seating surface is formed by a surface of the insert.

* * * * *